United States Patent [19]

Batchelor

[11] Patent Number: 4,468,832

[45] Date of Patent: Sep. 4, 1984

[54] REFILL SPONGE MOP ASSEMBLY

[75] Inventor: Douglas R. Batchelor, Chicago, Ill.

[73] Assignee: Libman Broom Company, Arcola, Ill.

[21] Appl. No.: 507,590

[22] Filed: Jun. 24, 1983

[51] Int. Cl.[3] ..... A47L 13/10

[52] U.S. Cl. ..... 15/244 R; 15/119 A

[58] Field of Search ..... 15/116 A, 119 A, 244 R, 15/244 A, 244 B, 244 C

[56] References Cited

U.S. PATENT DOCUMENTS 3,188,676 6/1965 Zelinski et al. ..... 15/244 R 3,394,424 7/1968 Spronsen et al. ..... 15/244 R

*Primary Examiner*—Edward L. Roberts

*Attorney, Agent, or Firm*—Marshall, O'Toole, Gerstein, Murray & Bicknell

[57] ABSTRACT

This disclosure relates to a sponge mop refill assembly designed for use with different mop head designs. The assembly includes a sponge, a pair of backing plates secured to one side of the sponge, and an adapter for each backing plate. Sponge mop heads include a squeeze plate that extends across the upper side of the sponge and is removably attached to the two backing plates on the sponge. In one mop head design, the squeeze plate and the backing plates include mating mating slot and flange parts for connecting the backing plates directly to the squeeze plate. In another mop head design, the connecting part on the squeeze plate is recessed and therefore not directly accessible to the mating part on the backing plate, and in this instance the adapters are positioned between and interconnect the squeeze plate with the backing plates. In still another mop head design, screw holes are formed through the squeeze plate, and the assembly may further include screws and nuts for connecting the backing plates to the squeeze plate.

8 Claims, 20 Drawing Figures

FIG. 2
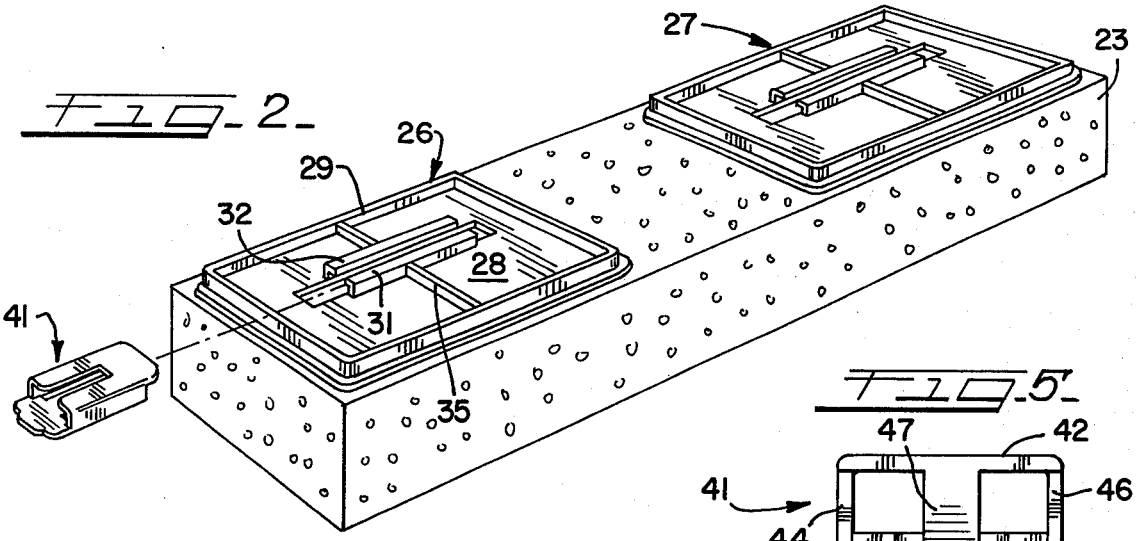
FIG. 5
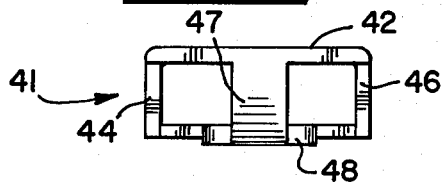
FIG. 3
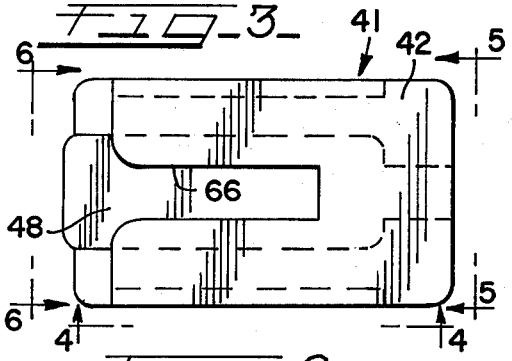
FIG. 4
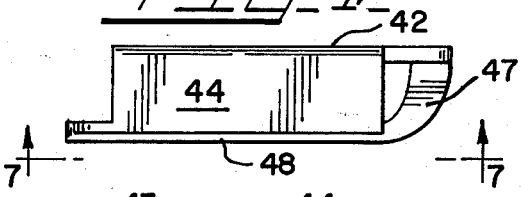
FIG. 6
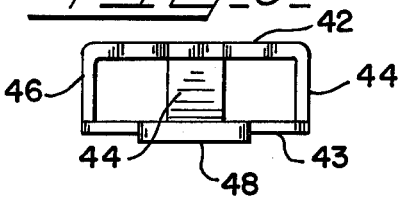
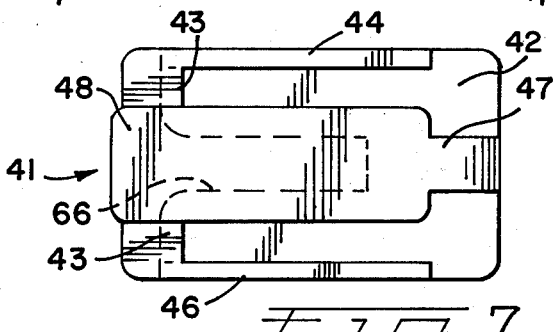
FIG. 7
FIG. 12
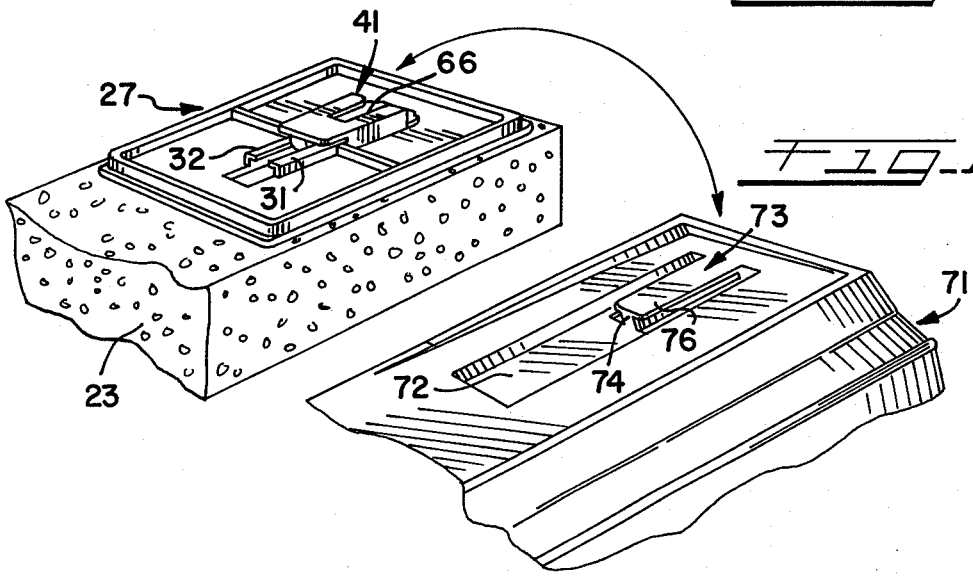

FIG. 15
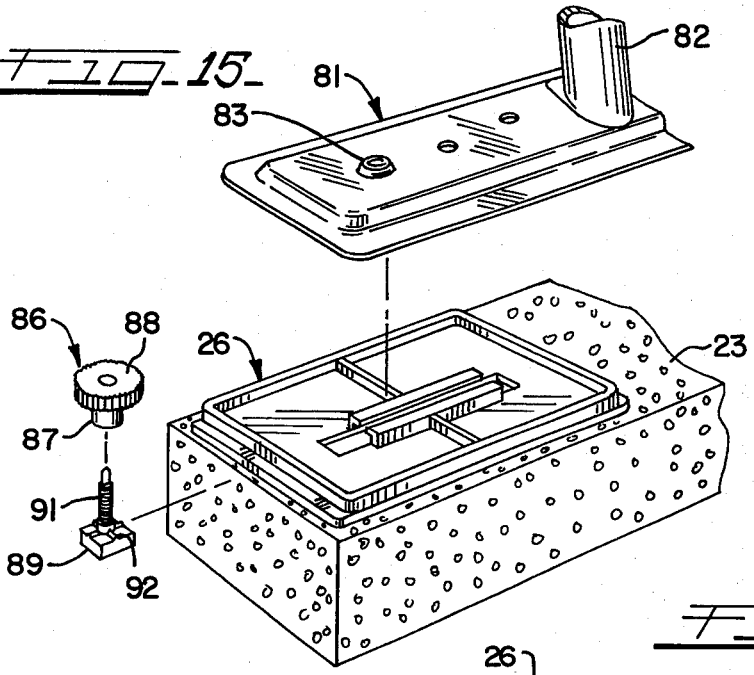
FIG. 16
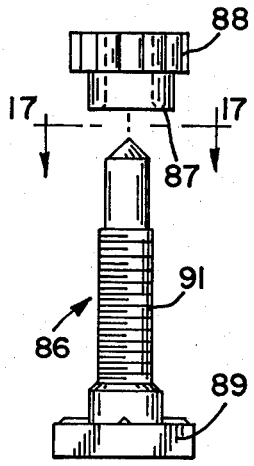
FIG. 19
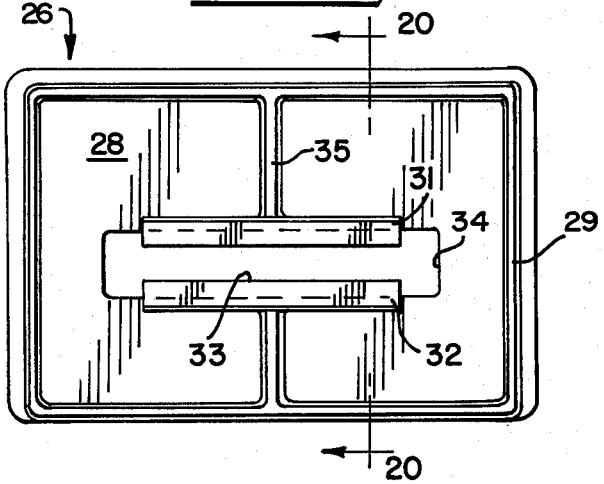
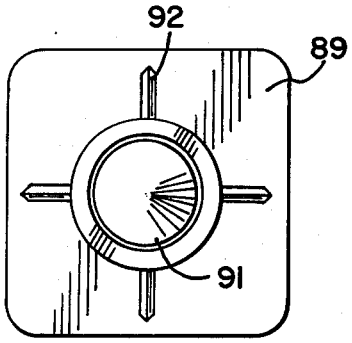
FIG. 17
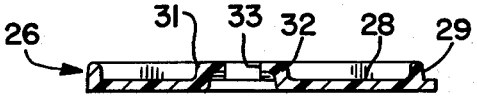
FIG. 20
FIG. 18
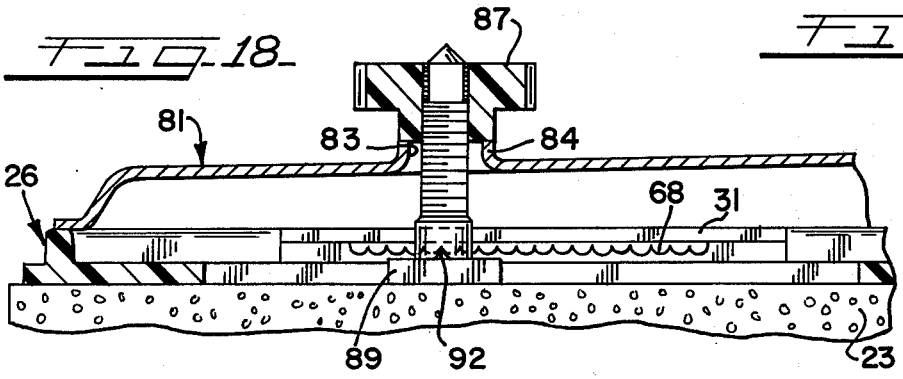

REFILL SPONGE MOP ASSEMBLY

This disclosure relates to sponge mops, and more particularly to a refill or replacement sponge assembly for a sponge mop.

A variety of different sponge mop designs have been developed and have been on the market for many years, which are designed primarily for domestic use. Such a sponge mop normally includes a mop head attached to the lower end of a rod or handle, and a squeeze mechanism for extracting water from a sponge fastened to the head. In some mop designs the mechanism produces a medial fold in the sponge and presses two halves of the sponge together in order to force water out of it. In another design, two presser plates are hinged together so that they may sandwich the sponge between them and squeeze out the water.

The sponge of such a mop normally wears out or deteriorates with continued use, and the sponge is fastened to the mop head such that a worn sponge can be removed and a replacement sponge provided in its place. Sponge refills have been marketed for this purpose, but there is a problem in this regard in that the different mop head designs have required that a variety of sponge refills also be provided. For example, U.S. Pat. No. 3,188,676 shows a sponge mop wherein the sponge is fastened to the head by a "slot and tab arrangement," a slotted member being attached to the sponge and a mating tab being formed on a presser or squeeze plate. This patent also shows an arrangement that does not include a tab but instead includes a screw-nut for fastening the sponge to the head. U.S. Pat. No. 3,014,230 also shows a screw-nut for this purpose. A further complication is that in some slot and tab arrangements, the tab is formed on a deeply recessed portion of a squeeze plate whereas in other arrangements the tab is formed on a shallowly recessed portion of a squeeze plate. The foregoing differences have required that different refill constructions be manufactured, stocked and marketed.

It is a general object of this invention to provide an improved refill sponge mop assembly which may be used with a number of different mop head designs.

An assembly in accordance with the present invention comprises a generally rectangular sponge, two backing plates secured to one side of the sponge, the plates being longitudinally separated, and an adapter for each backing plate.

Each backing plate includes a flat section, one side of which is secured to the sponge. A raised portion is formed centrally of the flat section and a longitudinal slot is formed in the raised portion. When the assembly is used with a mop head design having a shallow recessed squeeze plate with a tab thereon, the sponge is attached to the squeeze plate by connecting the tab in the slot of the backing plate.

When the assembly is used with a deeply recessed squeeze plate, the adapters are fastened between the backing plates and the squeeze plate. Each adapter includes a flange adapted to be inserted into the slot of a backing plate. This flange is formed on one side of the adapter, and on its opposite side is formed a slot that is similar to the slot of the backing plate. Each adapter is fastened in the slot of a backing plate and it is also fastened to a tab of the squeeze plate.

The assembly may also include screw-nuts for connecting the backing plates to the mop head, each screw-nut extending between the raised portions and the squeeze plate.

Other objects and advantages of the present invention will become more apparent from the following detailed description taken in conjunction with the accompanying figures of the drawings, wherein:

FIG. 2 is an enlarged exploded perspective view of a sponge mop refill assembly in accordance with this invention;

FIG. 3 is a further enlarged plan view of an adapter of the assembly;

FIG. 4 is a view taken on the line 4—4 of FIG. 3;

FIG. 5 is a view taken on the line 5—5 of FIG. 3;

FIG. 6 is a view taken on the line 6—6 of FIG. 3;

FIG. 7 is a view taken on the line 7—7 of FIG. 4;

FIG. 12 is an exploded perspective view of an assembly according to this invention adapted to be attached to still another mop head design;

FIG. 15 is an exploded perspective view of a sponge mop refill adapted to be attached to still another mop head design;

FIG. 16 is an enlarged view of a screw-nut of the assembly shown in FIG. 15;

FIG. 17 is a further enlarged view taken on the line 17—17 of FIG. 16;

FIG. 18 is a fragmentary sectional view of the structure shown in FIG. 15 in fully assembled relation;

FIG. 19 is a top plan view of a backing plate of the assembly; and

FIG. 20 is a sectional view taken on the line 20—20 of FIG. 19.

Figures 1, 8, 9, 10, 11, 13, 14:
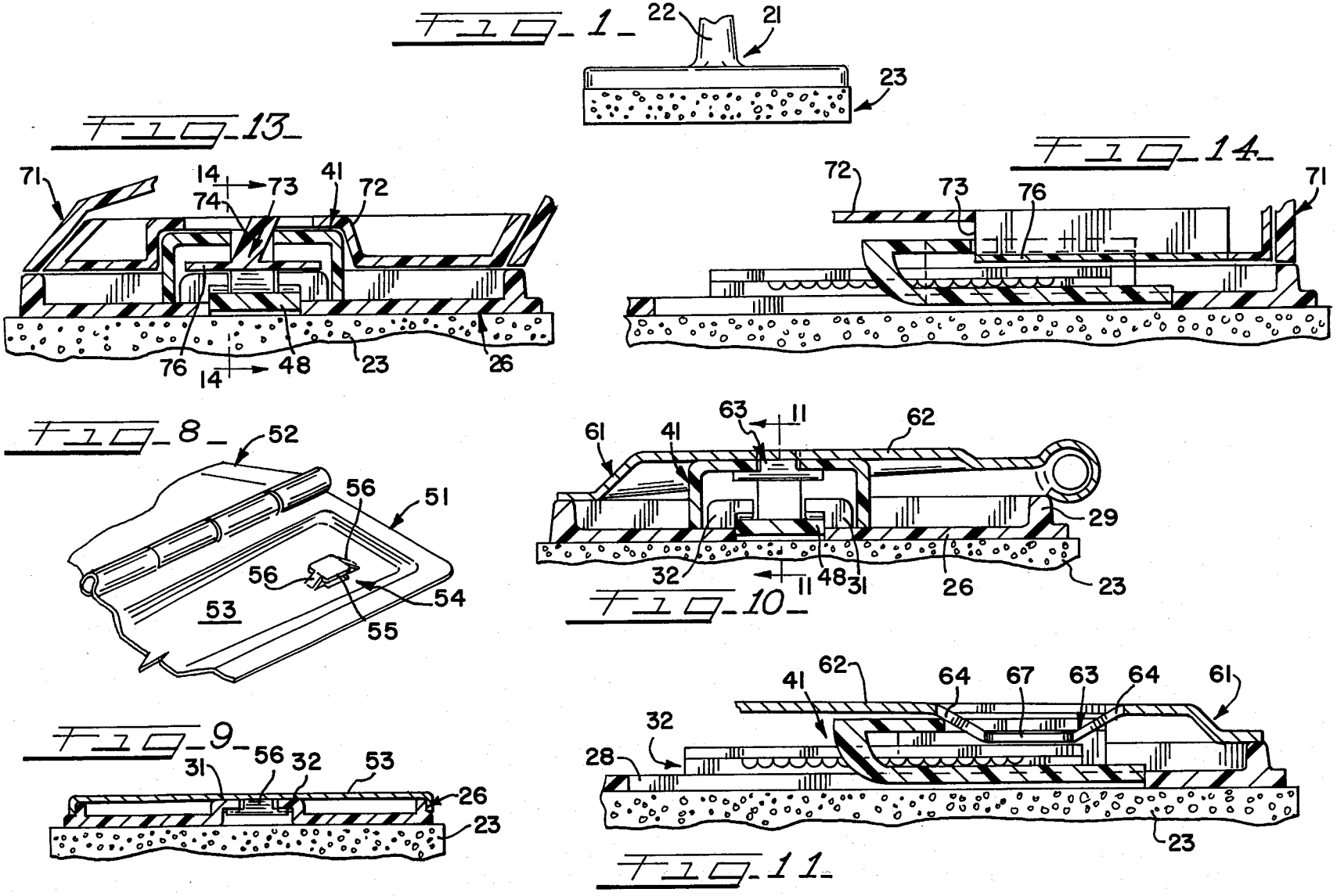
FIG. 1 is a fragmentary view of a sponge mop including apparatus in accordance with this invention.
FIG. 8 is a fragmentary perspective view of a portion of a mop head adapted to receive an assembly according to this invention.
FIG. 9 is an enlarged sectional view of a refill assembly attached to the mop head shown in FIG. 8.
FIG. 10 is a sectional view of an assembly according to this invention attached to another mop head design.
FIG. 11 is a fragmentary sectional view taken on the line 11—11 of FIG. 10.
FIG. 13 is an enlarged sectional view showing the structure of FIG. 12 in assembled relation.
FIG. 14 is a fragmentary sectional view taken on the line 14—14 of FIG. 13.

With reference first to FIG. 1, a sponge mop includes a mop head 21 adapted to receive a handle (not shown) in a handle holder portion 22. Attached to the bottom side of the mop head 21 is a sponge 23, better shown in FIG. 2. The sponge mop shown in FIG. 1 normally also includes a squeeze mechanism (not shown) which may have a conventional design, for squeezing water from the sponge 23. Since various squeeze mechanisms are well known in the art and are not part of this invention, such a squeeze mechanism is not shown or described herein.

FIG. 2 illustrates a refill assembly in accordance with this invention, comprising a generally rectangular block 23 of sponge material and, attached to the upper side of the sponge block 23, two backing plates 26 and 27. The two backing plates are attached to the opposite ends of the sponge block and serve the dual functions of providing backing for the soft sponge material and for attaching the sponge block to the mop head 21. Each backing plate (see FIGS. 2, 19 and 20) includes a substantially flat plate portion 28 that is positioned against the upper surface of the sponge block 23 and secured thereto by, for example, a suitable adhesive. Extending around the circumference of the plate portion 28 and on the upper side thereof is a reinforcing or strengthening rib 29. The backing plates are elongated in the long or longitudinal direction of the sponge block 23, and each plate further includes two longitudinal raised portions 31 and 32 which extend upwardly above the surface of the plate portion 28, the upper levels of the raised portions 31 and 32 being substantially flush or even with the rib 29 as shown in FIG. 20. A slot 33 separates the two raised portions 31 and 32, and a longitudinally elongated opening 34 is formed in the plate portion 28 below the raised portions 31 and 32. As best illustrated in FIG. 19, the opening 34 extends beyond both ends of the raised portions 31 and 32 and the opening 34 has a larger width than the slot 33. Thus the opening 34 in conjunction with the slot 33 forms a keyhole configuration at each end of the raised portions 31 and 32. To further strengthen the backing plate 26 and 27, an intermediate reinforcing rib 35 is formed on the upper side of the plate portion 28 and extends between the raised portions 31 and 32 and the circumferential rib 29. The intermediate rib 35 also has a height that is substantially equal to that of the upper level of the raised portions 31 and 32 and the rib 29.

With reference once again to FIG. 2, the mop refill assembly further includes an adapter 41 for each of the backing plates 26 and 27, the construction of an adapter 41 being best illustrated in FIGS. 3–7. The adapter 41 includes a top wall 42 and a bottom wall 43 which are joined together by two side walls 44 and 46 and by a center key 47. The key 47 has a lateral width, shown in FIG. 6, that is slightly less than the lateral width of the slot 33 of the backing plates 26 and 27, so that the adapter 41 may be assembled with a backing plate by positioning the key 47 in the slot between the two raised portions 31 and 32. A laterally enlarged flange 48 (FIGS. 6 and 7) forms part of the bottom wall 43 and is attached to the key 47 and to the ends of the side walls 44 and 46. The width of the flange is slightly less than that of the opening 34, and its thickness is slightly greater than that of the adjoining wall portions. When assembled, the key 47 is located in the slot 33 as shown, for example, in FIG. 12, the flange 48 is located below the two raised portions 31 and 32, and the top wall 42 is located above the upper surfaces of the two raised portions 31 and 32. The two side walls 44 and 46 extend on opposite sides of the two enlarged portions 31 and 32, and there is a relatively snug fit between these parts. With reference again to FIG. 12, when the adapter is moved to the position where the two side walls 44 and 46 abut the intermediate rib 35, the flange 48 extends into the opening 34 of the backing plate. The flange 48 is sized to fit snugly in the opening 34 on either side of the rib 35, and once it has been snapped into place, it is prevented from moving longitudinally by the rib 35 and by the outer end of the opening 34. The backing plates 26 and 27 and the adapters are preferably made of a plastic material such as acrylic PVC plastic which is relatively rigid but nevertheless somewhat flexible to enable the parts to be flexed when being assembled.

The refill mop assembly shown in FIG. 2 is adapted to be used with a variety of mop head designs, such as the design shown in FIGS. 8 and 9, and when the assembly is used with this head design, the adapters 41 are not utilized. This mop head includes a generally rectangular squeeze plate 51 that has another squeeze plate 52 hinged to it along one edge. The sponge 23 is adapted to be attached to squeeze plate 52 and when the user wishes to extract the water from the sponge he pivots the squeeze plate 52 over the plate 51 in order to sandwich the sponge between them. The squeeze plate 51 has a relatively shallow recessed interior area 53, and a pair of flanged holding tabs 54 are formed in the area 53 adjacent the ends of the plate 51. The plate 51 may be made, for example, of sheet metal and the recessed area 53 and the two holding tabs 54 may be punched or stamped therein. The two backing plates 26 and 27 are located such that the raised portions 31 and 32 are adjacent the holding tabs 54 when the sponge is moved to the plate 51. With reference to FIG. 9, each holding tab has a flange 55 that is offset from the adjoining part of the area 53, and the flange is supported by two support keys 56. The width of the two support keys 56 is slightly less than the width of the slot 33, and the flange 54 is spaced from the surface of the recessed area 53 by a distance that is slightly greater than the thickness of the raised portions 31 and 32. This relation is illustrated in FIG. 9, and it will be apparent that each tab is attached to a backing plate by sliding the flange 54 underneath the raised portions 31 and 32, with the keys 56 moving within the slot 33. When assembling a sponge block to the squeeze plate 51, first one backing plate is attached to a holding tab 54, then the sponge is manually compressed or buckled at its center to enable the other backing plate to be attached to the tab at the opposite end of the squeeze plate.

As previously mentioned, in the arrangement shown in FIGS. 8 and 9, the backing plates 26 and 27 are attached directly to holding tabs formed on the squeeze plate 51 of the mop head, and this is possible where the recessed area 53 is relatively shallow. In the mop head design shown in FIGS. 10 and 11, the squeeze plate 61 has a relatively deep recess and the adapters 41 are interposed between the backing plates 26 and 27 and the squeeze plate in order to interconnect them. With specific reference to FIGS. 10 and 11, the squeeze plate 61 includes a relatively deeply recessed center area 62 that has flanged holding tabs 63 formed thereon, which are similar to the tabs 54 shown in FIGS. 8 and 9. When assembling the sponge 23 to the plate 61, an adapter 41 is connected to each tab 63 by positioning the adapter with the support keys 64 in the elongated slot formed in the top wall 42 of the adapter. The width of the slot 66 is slightly greater than the width of the support keys 64, and the slot 66 corresponds in function to the slot 33 formed in the backing plates. The flange 67 of each tab extends below the top wall 42 as shown in FIG. 10 and the flange 67 is offset from the adjoining portion of the area 62 by an amount which is slightly greater than the thickness of the top wall 42 of the adapter. Thus, the refill assembly is connected to the squeeze plate 61 by attaching an adapter to each of the backing plates 26 and 27 and attaching the adapters to the holding tabs 63 of the squeeze plate.

With reference to FIG. 11, it will be noted that the undersurfaces of the two raised portions 31 and 32 have a series of ripples 68 formed thereon, and the function of the ripples 68 will be discussed in connection with FIGS. 15–18. When used with the adapter, the ripples 68, however, are not necessary.

FIGS. 12–14 show another arrangement wherein the adapters 41 are utilized to connect the backing plates 26 and 27 to a squeeze plate 71 of another mop head design. In this arrangement the mop head is formed of a molded plastic, for example, and the plate 71 has a deeply recessed portion 72, best shown in FIGS. 12 and 13, formed adjacent each end thereof. The recessed portions 72 extend longitudinally of the plate 71, and adjacent the outer end of each recessed portion 72 is formed a flanged holding tab 73. Each flanged holding tab 73 corresponds in general configuration and function to the tabs 54 and 63, and includes a support key 74 and a flange 76 which is offset from the adjoining recessed area 72 of the squeeze plate. In a manner similar to the arrangement shown in FIGS. 10 and 11, the tabs 73 are connected to the adapters 41 by positioning the adapters with the keys 74 extending into the slots 66, the flanges 76 thereby being located in the spaces between the top and bottom walls of the adapter. The adapters are connected to the backing plates as previously described and as shown in FIGS. 10 to 12.

In the foregoing constructions, the sponge mop refill is connected to mop heads having flanged holding tabs, but there are also mop head constructions where screw-nuts. are required to fasten the sponge to the squeeze plate. FIGS. 15 through 18 show how the sponge and backing plates illustrated in FIG. 2 may also be used with such a mop head design. The mop head includes a squeeze plate 81 attached to the lower end of a handle 82, the mop head including holes 83 formed at opposite ends of the squeeze plate 81. In the present illustration, best shown in FIGS. 15 and 18, the holes 83 have upwardly extending flanges 84 which may be provided to strengthen the hole area.

A screw-nut 86 is provided for connecting each backing plate to the squeeze plate 81. The preferred form of screw-nut 86 includes a nut 87 having an enlarged serrated head 88. The screw includes a square head 89 attached to a threaded shank 91. The width and the thickness of the square head 89 are sized such that the head may be positioned below the enlarged portions 31 and 32 of the associated backing plate, as shown in FIG. 18. The bottom side of the head 89 engages the sponge 23 which urges the screw upwardly into engagement with the underside of the enlarged portions 31 and 32. The upper side of the head 89, which is the side that is adjacent the shank 91, has ribs 92 formed thereon, the ribs being best shown in FIG. 17. The ribs 92 are designed to fit between the previously described ripples 68 formed on the undersides of the raised portions 31 and 32, with the result that the screw may be moved to a selected location along the length of the slot 33, and the engagement between the ribs 92 and the ripples 68 will hold the screw at the selected location. Thus, when connecting a refill sponge to the squeeze plate 81, the screws may be fastened to the backing plates at the appropriate locations for alignment with the holes 83, and they will remain in upright positions at these locations while the squeeze plate 81 is moved over the backing plates. The square heads 89, of course, prevent the screws from rotating due to their engagement with the sides of the raised portions 31 and 32.

It will be apparent from the foregoing that a novel and advantageous refill mop assembly has been provided. The assembly shown in FIG. 2 and including two adapters 41 may be assembled to mop heads including flanged holding tabs. Where the tabs are formed on deeply recessed portions of the mop head, the adapters are utilized to interconnect the backing plates to the mop head, but when the tabs are formed in a shallow recessed area, the adapters are not utilized. The upper wall of the adapter, of course, corresponds in configuration and function to the slotted raised portions of the backing plates whereas the bottom walls of the adapters correspond in configuration and function to the flanged holding tabs of the squeeze plates.

Where it is desired that the mop refill be also designed for use with mop heads as shown in FIGS. 15–18, the refill assembly may also include screw-nuts for connecting the backing plates directly to the squeeze plates. In an instance where the holes 83 are formed in a deeply recessed part of the squeeze plate, the adapters 41 may be attached to the backing plates and the screws (FIG. 16) may be positioned in the slots 66 of the adapters. The versatility of the refill assembly makes unnecessary the marketing of a variety of refill constructions.

What is claimed is:

1. A refill sponge mop assembly comprising a sponge, a backing plate secured to one side of said sponge, said backing plate including first connecting means thereon, an adapter having at least two sides, said adapter including second connecting means on one of said two sides and third connecting means on the other of said two sides, said first and second connecting means having mating configurations and being interengageable, and said first and third connecting means having similar constructions.

2. An assembly as in claim 1, wherein said second connecting means comprises a support key and a flange on said key, and said first and third connecting means comprise slotted means adapted to receive a key and flange.

3. An assembly as in claim 1, wherein said first connecting means comprises two raised portions of said backing plate, said raised portions having a slot therebetween, said second connecting means comprising a flange and a support key connecting said flange to adjoining portions of said adapter, said key being adapted to extend through said slot and said flange being adapted to extend between said raised portions and said sponge.

4. An assembly as in claim 3, wherein said third connecting means comprises a slot in said other side and having a size similar to said slot of said first connecting means.

5. An assembly as in claim 3, wherein said backing plate has an opening therein between said raised portions, said flange of said second connecting means being adapted to extend into said opening.

6. An assembly as in claim 5, wherein said raised portions, said slot and said opening of said first connecting means are elongated and generally parallel, said backing plate further including at least one rib connected to said raised portion, said adapter being adapted to be retained between an end of said opening and said rib.

7. An adapter for use with a replacement sponge and a mop head, said head including a plate and a flange attached to said plate by a support, said flange being spaced from the adjoining surface of said plate, said sponge including a backing plate on one side thereof, said backing plate including a raised portion thereon having a slot formed therein, said adapter comprising first and second opposed walls, said first wall forming an adapter flange, a key connecting said adapter flange with said second wall, said adapter flange being adapted to be positioned between said raised portion and said sponge and said key being adapted to extend through said slot in said raised portion, and said second wall of said adapter having a slot formed therein which is adapted to receive said support of said head plate, said flange of said head plate being adapted to extend between said first and second walls.

8. A sponge mop head, comprising (a) a squeeze plate;

(b) a generally rectangular replaceable sponge;

(c) a pair of backing plates attached to one side of said sponge at spaced locations;

(d) an adapter for each of said backing plates;

(e) first releaseable attaching means connecting each adapter to its associated backing plate and including mating connecting parts on said adapter and said backing plate;

(f) second releaseable attaching means connecting each adapter to said squeeze plate and including mating connecting parts on said adapter and said squeeze plate;

(g) said mating parts of said backing plates and said squeeze plate further having mating configurations and being interconnectable.

* * * * *